US005314600A

United States Patent [19]

Webb et al.

[11] Patent Number: 5,314,600

[45] Date of Patent: May 24, 1994

[54] EDGE STRIP

[75] Inventors: Wayne K. Webb, Bowen; Martin K. Schonfeldt, Pimlico; Damian G. Lillicrap, Mysterton Estate, all of Australia

[73] Assignee: Copper Refineries Pty. Ltd., Queensland, Australia

[21] Appl. No.: 868,768

[22] Filed: Apr. 16, 1992

[30] Foreign Application Priority Data

Apr. 23, 1991 [AU] Australia ..... 75360/91

[51] Int. Cl.[5] ..... C25C 7/08; C25D 17/00

[52] U.S. Cl. ..... 204.1/279; 204/281

[58] Field of Search ..... 204/279, 281; 205/76

[56] References Cited

U.S. PATENT DOCUMENTS

| | | | |
|---|---|---|---|
| 2,536,877 | 1/1951 | Emanuel et al. | 204/281 |
| 3,331,763 | 7/1967 | Mabey | 204/281 X |
| 3,804,724 | 4/1974 | Bolger et al. | 205/76 |
| 3,830,710 | 8/1974 | Narozanski et al. | 205/76 |
| 4,288,312 | 9/1981 | Johnson et al. | 204/286 X |
| 4,776,928 | 10/1988 | Perlich | 205/76 |

FOREIGN PATENT DOCUMENTS

| | | |
|---|---|---|
| 506521 | 1/1980 | Australia . |
| 6114480 | 3/1984 | Australia . |

*Primary Examiner*—Donald R. Valentine

*Attorney, Agent, or Firm*—Stevens, Davis, Miller & Mosher

[57] ABSTRACT

The invention relates to an edge strip for a cathode plate. The edge strip comprises a non-inflatable elongate body of a thermoplastic material which body includes a longitudinal opening to accommodate an edge of the cathode plate and at least one continuous longitudinal internal groove on an inside surface of the opening.

8 Claims, 1 Drawing Sheet

EDGE STRIP

BACKGROUND OF THE INVENTION

The present invention relates to cathodes, and in particular to an edge strip for a cathode plate.

The use of cathode plates in metal deposition processes, and particularly for copper, is well known. During the process metal particles are deposited on either side of the cathode plate. During removal the plate is flexed to loosen the material and it is desirable to protect at least the two side edges of the plate so that material does not accumulate around the side edges to inhibit the removal of the metal. One known method of protecting the edge during this process is to coat the edge with a layer of wax. This procedure has been found to be labor intensive, messy and unreliable. Cracks in the wax allow bridging of the metal between the two sides and fresh application of wax is required after each use. It is therefore necessary to have large quantities of wax available for use.

To combat some of these problems an edging strip was developed which was placed around the edge of the plate and attached by way of pins through holes in the plate and the edge strip. However, this process was also highly labor intensive and required skill to locate and line up the corresponding holes in the edge strip and plate. Bridging also occurred between the hole in the plate and the pin. It has been proposed to utilize an inflatable edge strip which when pressurized would clampingly grip the side walls of the plate. However, that method was found to be ineffective and costly.

SUMMARY OF THE INVENTION

It is therefore an object of the present invention to ameliorate at least one of the disadvantages of the prior art by providing an improved edging strip and an improved cathode plate.

According to a first aspect the present invention consists in an edge strip for a cathode plate comprising a non-inflatable elongate body of a thermoplastic material and including a longitudinal opening on one side of said body to accommodate an edge of the cathode plate, and at least one continuous longitudinal internal groove on an inside surface of the opening.

Preferably there are two continuous and opposed internal grooves to receive pegs or tabs protruding from a side wall of the cathode plate.

According to a second aspect the invention consists in a cathode plate adapted for engagement with an edge strip and including formations on at least one side adjacent an edge of said plate, said formations being adapted to engage with said edge strip.

Preferably the formations include pegs inserted through holes in the plate, these pegs being plastic or metal.

In a preferred embodiment the pegs are of the same material as the plate and are welded thereto.

A further preferred embodiment uses tabs pressed from the plate as the formations, either all are one side or alternatively.

The present invention has the advantage that as there are no pinning holes there is no possible current path which would allow metal to be deposited on the edge. The positive location of the edge strip along its vertical axis also prevents dislodgement of the strip during mechanical or manual handling.

BRIEF DESCRIPTION OF THE DRAWINGS

Some preferred embodiments of the present invention will now be described, by way of example only, with reference to the accompanying drawings in which.

DETAILED DESCRIPTION OF PREFERRED EMBODIMENTS

Figure 1:
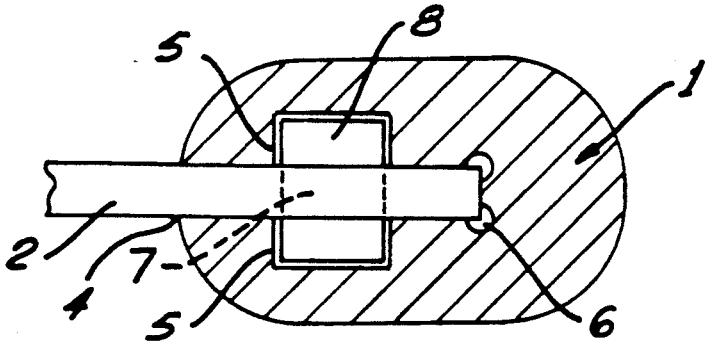
FIG. 1 is a schematic representation of a plan view of an edge strip and cathode plate according to the invention.

Referring to the drawings, there is an edge strip 1 attached to the edge of a cathode plate 2. Edge strip 1 is made from any thermoplastic material such as PVC, CPVC, PVC/acrylic co-polymer, and is a generally an elongated extruded body. An opening 4 is formed on one side of strip 1 and is also generally elongate along the longitudinal axis of strip 1, to receive the edge of cathode plate 2. Continuous longitudinal grooves 5 are formed on opposed inside surfaces of opening 4 during the extrusion process. Also formed during the extrusion process are expansion channels 6 which allow for the thermal expansion of cathode 2.

In FIG. 1 cathode plate 2 has a hole 7 formed therethrough adjacent the edge. A peg 8 of say plastic or metal is inserted through hole 7. A plurality of such holes and pegs are located down the edge of plate 2 in an orderly manner to form a ridge, the number varying with the size of plate 2.

In use, edge strip 1 is slid over and down the edge of cathode 2 and over the ridge of formations formed by the pegs 8. Grooves 5 form channels in which pegs 8 are accommodated. This arrangement provides a positive seal against cathode 2 which inhibits ingress of the electrode deposited material under the edge strip. Edge strip 1 may also be removed without damage to permit under edge inspection and cleaning. Furthermore, expansion or contraction of edge 1 will not effect the fastening means and not result in bridging of the metal.

Figure 2:
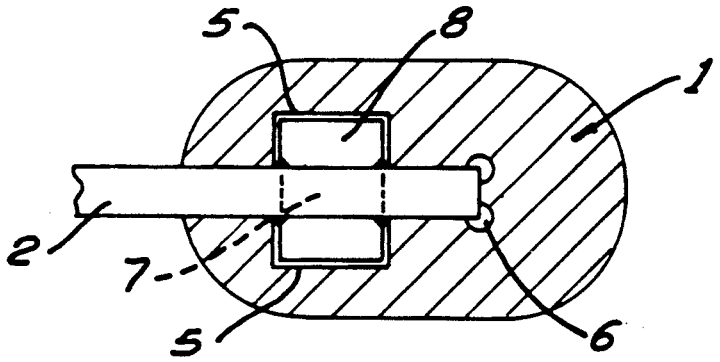
FIG. 2 is a plan view of the edge strip of FIG. 1 with a variation of the cathode plate.

A further embodiment of the invention is seen in FIG. 2 wherein the same edge strip is used over the cathode plate 2 however instead of simply inserting peg 8 through hole 7, a metal peg of the same material as the mother plate is welded into hole 7.

Figure 3:
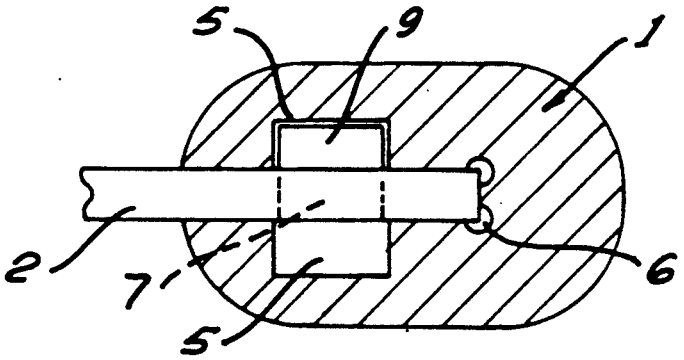
FIG. 3 is a plan view of the edge strip of FIG. 1 and a further variation of the cathode plate of the present invention.

Yet a further embodiment is seen in FIG. 3 wherein the formations on plate 2 are tabs punched from the mother plate 2 to one side. A plurality of tabs 9 can be pressed either all to one side or on alternate sides.

Although the invention has been described with reference to specific examples, it will be appreciated by those skilled in the art that the invention may be embodied in many other forms.

We claim:

1. A cathode plate edge strip comprising:

a non-inflatable elongate body of a thermoplastic material and including a longitudinal opening on one side of said body to accommodate an edge of the cathode plate;

at least one continuous longitudinal internal groove on an inside surface of the opening; and at least one expansion channel on the inside surface of the opening to allow for thermal expansion of the cathode plate.

2. An edge strip according to claim 1 in which the cathode plate includes a formation on a side edge thereof, which formation is positioned to be covered by said edge strip and the groove is shaped and positioned to engage said formation.

3. An edge strip according to claim 2 wherein the formation on the cathode plate is a peg protruding from a side wall of the cathode plate.

4. An edge strip according to claim 3 wherein the peg is inserted through a hole in the cathode plate.

5. An edge strip according to claim 3 wherein the peg is plastic.

6. An edge strip according to claim 3 wherein the peg is metal and is welded onto the cathode plate.

7. An edge strip according to claim 2 wherein the internal groove is shaped and positioned to engage a plurality of formations on at least one side adjacent an edge of the cathode plate.

8. An edge strip according to claim 2 wherein there are two continuous and opposed internal grooves and said formation is a plurality of pegs protruding from a side wall of the cathode plate and positioned to be received in said two grooves.

* * * * *